United States Patent [19]

Guibert

[11] Patent Number: 4,557,479

[45] Date of Patent: Dec. 10, 1985

[54] ARTICULATED MANUAL EXERCISE BAR

[76] Inventor: Raul Guibert, 10374 Summer Holly Cir., Los Angeles, Calif. 90024

[21] Appl. No.: 627,663

[22] Filed: Jul. 3, 1984

[51] Int. Cl.[4] ..... A63B 11/00

[52] U.S. Cl. ..... 272/122; 272/67; 272/117; 272/128; 272/143

[58] Field of Search ..... 272/122, 124, 123, 117, 272/132, 140, 128, 143, 67, 68, 135, 136, 116

[56] References Cited

U.S. PATENT DOCUMENTS

| | | | |
|---|---|---|---|
| 64,081 | 4/1867 | Dibble | 272/124 |
| 2,233,764 | 3/1941 | Bauermeister | 272/140 X |
| 2,356,260 | 8/1944 | Maxwell | 272/136 |
| 4,089,520 | 5/1978 | Ozbey et al. | 272/143 X |
| 4,108,429 | 8/1978 | Minichiello | 272/140 X |

*Primary Examiner*—Richard J. Apley

*Assistant Examiner*—Robert W. Bahr

*Attorney, Agent, or Firm*—Michael Ebert

[57] ABSTRACT

An articulated exercise bar having left and right hand weighted arms provided with rotatable handles. The arms are joined together by a rotatable hinge assembly making it possible for the arms to be held initially at parallel positions lying within a main plane passing through the longitudinal axis of the arms. The rotating hinge assembly permits a user grasping the rotatable handles to swing the arms in and out within the main plane or at right angles thereto, or to rotate the entire bar and to thereby execute more or less complex movements which function to bring into play and develop many of the muscles in the muscular system associated with the user's arms which are uninvolved in conventional arm exercisers.

5 Claims, 3 Drawing Figures

ARTICULATED MANUAL EXERCISE BAR

BACKGROUND OF INVENTION

This invention relates generally to manual exercisers suitable for athletic or therapeutic purposes, and more particularly to an articulated exercise bar formed by left and right hand weighted arms joined together by a rotatable hinge assembly which renders the bar capable of undergoing complex motions which bring into play and develop many of the muscles in the muscular system associated with the user's arms which are uninvolved in conventional arm exercisers.

In contemporary society, large-scale mechanization has sharply reduced the need for an expenditure of physical energy in the production of goods and services. Indeed, the aim of most inventions is to provide a labor-saving device to supplant human effort. But while modern man has been relieved of the Biblical injunction to earn his daily bread by the sweat of his brow, this has been a mixed blessing; for the resultant inactivity has given rise in affluent societies to serious obesity problems and has impaired the ability of many persons to carry out their normal tasks with a reasonable degree of efficiency.

To remediate many of the physical fitness problems of the sedentary individual, various forms of exercisers have been conrived that are designed to develop muscular strength and endurance. By muscular strength is meant the measurable strength of muscles as determined by a single maximum contraction, and by muscular endurance is meant the ability of muscles to perform work for a given time period.

Muscles consist of many fibers held together by connective tissue and having the power to contract and relax and thereby perform the movement and the vital processes of the organism. The voluntary of striated muscles which are subject to the human will and control the body are attached by tendons to the skeleton. They constitute much of the body weight and appear as lean flesh.

Most manual exercisers in current use fall either into the isometric or isotonic class. An isometric exerciser is designed to sustain one muscular contraction and therefore operates on static tension, whereas an isotonic exerciser adapted to repeatedly raise or lower a weight or other load brings into play dynamic tension.

In a review by the President's Council on Physical Fitness and Sports of the research carried out on the comparative effects of isometric and isotonic training programs, the Council indicated a preference for the isotonic over the isometric form and concluded that isotonic training is superior in developing muscular strength and in improving muscular endurance. The Council pointed out that motivation is greater in isotonic exercising, for the participant can see what is being accomplished and explicit goals may be set.

Muscular power represents the ability to release maximum muscular force in the shortest time. Muscular strength is the strength of muscles as determined by a single maximum contraction, while muscular endurance is the ability of muscles to perform work for a given period of time. One may develop muscular power, strength and endurance by the use of bar bells, but the manipulation of bar bells up and down and sideways does not engage all of the shoulder and neck muscles as well as the arm and wrist muscles, and may therefore result in uneven development.

Other types of exercisers which make use of telescoping exercise bars that are joined together by a spring and pulled apart by the hands of the user, also result in uneven development, for the strength of the user is exerted only in one direction against the action of the spring and this operation does not engage all of the muscles associated with the arms. An improved form of this type of exerciser is that disclosed in the Spector U.S. Pat. No. 3,834,696 in which the telescoping bars are hydraulically interconnected.

SUMMARY OF INVENTION

In view of the foregoing, the main object of this invention is to provide an articulated exercise bar which functions as an isotonic exerciser and which brings into play a spectrum of dynamic tensions acting to develop the entire muscular system associated with the arms of the user.

More particularly, an object of the invention is to provide an articulated exercise bar formed by a pair of weighted left and right hand arms which are so hinged together that the user holding the arms is able to execute highly complex as well as simple motions.

Briefly stated these objects are accomplished by an articulated exercise bar having left and right hand weighted arms provided with rotatable handles. The arms are joined together by a rotatable hinge assembly making it possible for the arms to be held initially at parallel positions lying within a main plane passing through the longitudinal axis of the arms. The rotating hinge assembly permits a user grasping the rotatable handles to swing the arms in and out within the main plane or at right angles thereto, or to rotate the entire bar and to thereby execute more or less complex movements which function to bring into play and develop many of the muscles in the muscular system associated with the user's arms which are uninvolved in conventional arm exercisers.

OUTLINE OF THE DRAWINGS

For a better understanding of the invention as well as other objects and further features thereof, reference is made to the following detailed description to be read in conjunction with the accompanying drawings wherein.

DESCRIPTION OF THE INVENTION

Figure 1:
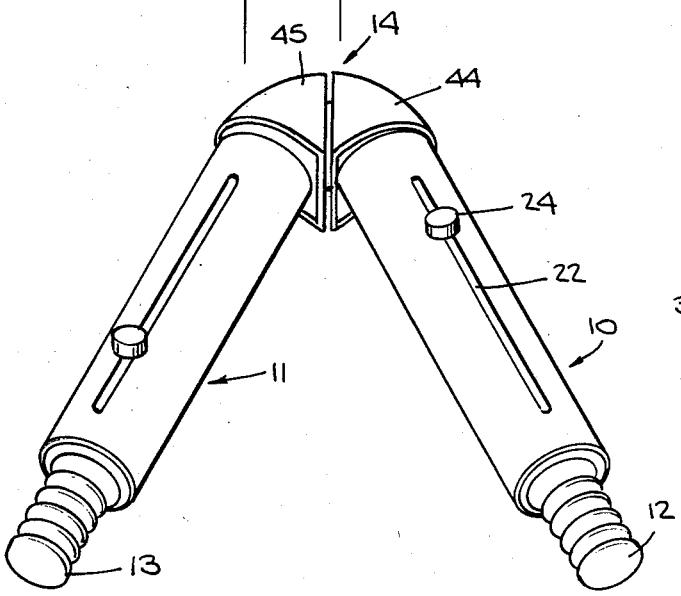
FIG. 1 is a perspective view of an articulated exercise bar in accordance with the invention.

Referring now to FIG. 1, an articulated exercise bar in accordance with the invention is constituted by left and right hand weighted arms 10 and 11 having rotatable handles 12 and 13, the arms being joined together by a rotatable hinge assembly 14.

Figure 2:
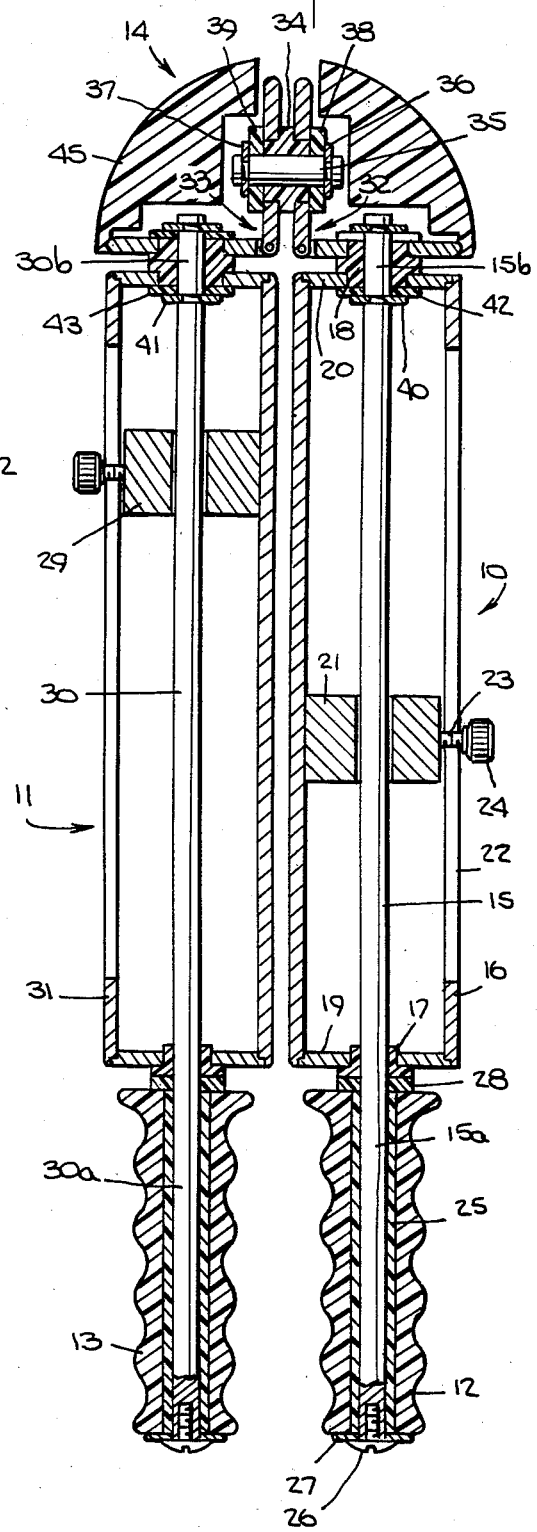
FIG. 2 is a section taken through the arms of the bar when they are positioned in parallel relation.

As shown in FIG. 2, right-hand arm 10 includes a shaft 15 coaxially supported within a cylindrical case 16 by upper and lower bearings 17 and 18 mounted in end plates 19 and 20. An annular weight 21 of steel or other massive material is slidable on shaft 15 within the case. The axial position assumed by the weight is adjustable within limits set by an elongated longitudinal slot 22 in the case. A screw 23 threadably received in a bore and projecting laterally from weight 21 extends through slot 22 and terminates in a knob 24.

Thus by axially shifting weight 21 on shaft 15 in a direction away from handle 12 and then turning in knob 24 to engage the wall of case 16, one may lock the weight at a desired position. Since this weight is more or less displaced depending on its setting from the user's hand gripping handle 12, the effective load imposed on the user's hand is leveraged, for it depends on the mass of the weight times its distance from the hand.

Handle 12 which may be molded or synthetic plastic material in a corrugated formation to provide a good grip is mounted on an internal sleeve 25 through which extends the lower end section 15*a* of shaft 15. To hold rotatable handle 12 on shaft section 15*a*, the end thereof is provided with a threaded bore which receives a screw 26. A low friction washer 27 is interposed between the head of screw 26 and the outer end of the handle. Another low-friction washer 28 is interposed between the bearing 17 and the inner end of the handle so that it can rotate freely on section 15*a*.

The left arm 11 has a structure identical to that of the right arm and includes an axially-adjustable weight 29 slidable on a shaft 30 supported by end bearings within a cylindrical case 31.

The rotatable hinge assembly which joins the weighted arms is constituted by a pair of hinges 32 and 33 each having an inner leaf and an outer leaf which assume a right angle bracket formation when arms 10 and 11 are held at parallel positions, as shown in FIG. 2. The outer leaves of hinges 32 and 33 are in parallel relation and are linked together by means of a common bearing 34 having a center bore which receives a locking pin 35 whose opposite ends are provided with locking rings 36 and 37 to hold the pin in place. The outer surface of bearing 34 has a pair of circumferential grooves to accommodate the outer leaves of hinges 32 and 33, low friction washers 38 and 39 being interposed between locking rings 36 and 37 and the faces of the outer leaves.

The inner leaves of hinges 32 and 33 are received on the end bearings of the left and right hand arms 10 and 11, the shafts 15 and 30 having upper sections 15*b* and 30*b* which pass through these bearings and are provided with locking rings 40 and 41. Interposed between these locking rings and the opposite end faces of bearing 34 are low-friction washers 42 and 43. All of the low friction washers may be formed of Teflon (PTFE) material. Protectively covering the hinges in the assembly are caps 44 and 45 molded of flexible foam plastic material.

Figure 3:
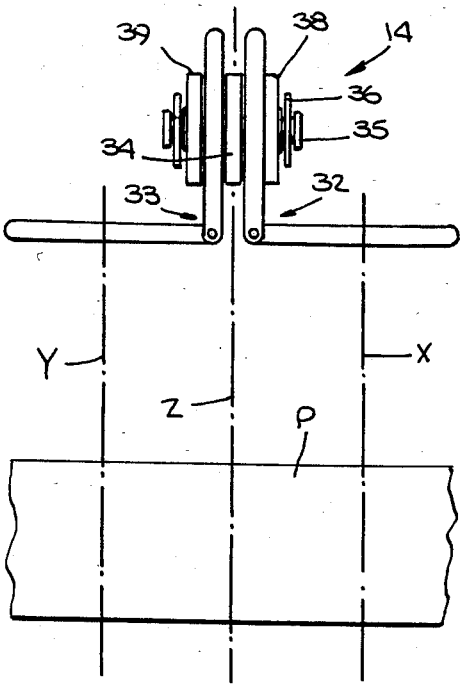
FIG. 3 is a separate view of the rotatable hinge assembly in relation to the axes of the parallel arms.

As shown in FIG. 3, the longitudinal axis X and Y of the arms 10 and 11 lie on opposite sides of the central axis Z and are parallel thereto when the arms are held in parallel relation as in FIG. 2. Because of the rotatable hinge assembly, the user who grips handles 12 and 13 may swing the arms in and out within a common plane P passing through axes X, Y and Z so that the arms then assume a V-formation. It is also possible to execute a scissor-like motion by swinging arms 10 and 11 in and out in a direction normal to plane P. And one can also by swinging the arms out within plane P to form a V, then rotate the entire bar in this V-formation using the hands for this purpose and rotating the hands about their wrists.

The amount of effort required to execute those more or less complex movements is determined by the weight settings, maximum strength being required when the weights are set at the upper ends of the slots the farthest distance away from the hands of the user. In practice, the arms of the exercise bar may be held with the arms of the user extended forwardly from the body or at a raised or lowered position thereby, further varying the possible exercise motions.

While there have been shown and described preferred embodiments of an articulated manual exercise bar, in accordance with the invention, it will be appreciated that many changes and modifications may be made therein without departing from the essential spirit thereof. Thus the exercise bar may have weights at fixed rather than at adjustable positions.

The expression "muscular system associated with the user's arms" as used herein is intended to cover the related shoulder, the forearm, the wrist and the hand and the muscles associated with these members.

I claim:

1. An articulated exercise bar comprising:

A. a pair of rotatable arms each having a handle at one end; and

B. a rotatable hinge assembly joining together the other ends of the arms and including a pair of hinges each having an inner and outer leaf, the inner leaves being coupled to the other ends of the arms, the outer leaves being coupled together in parallel relation by a common bearing to permit rotation of the hinges relative to each other on a common axis, said inner leaves being nominally in a straight-line relationship to each other and perpendicular to said outer leaves, whereby the arms may be initially held by a user gripping the handles thereof in parallel relation and then swung in and out in a common plane in a V-formation or swung in and out with a scizzor-like motion in a direction normal to the common plane, the bar when the arms are in a V-formation being rotatable between the hands of the user about the wrists to rotate the entire bar with a circular motion in space.

2. A bar as set forth in claim 1 wherein each arm includes a shaft coaxially supported within a cylindrical case by top and bottom end bearings through which a section of the shaft extends, said handles being rotatably supported on the bottom shaft section, and an annular weight being slidable along said shaft within the case.

3. A bar as set forth in claim 2, wherein said case is provided with a longitudinal slot and said weight is provided with a set screw that extends through the slot to hold the weight at a selected axial position on the shaft.

4. A bar as set forth in claim 2 wherein said inner leaves secured to the arms are rotatable on the top shaft section.

5. A bar as set forth in claim 1, wherein each hinge is protectively covered by a flexible foam plastic cap.

* * * * *